United States Patent [19]

Koornhof

[11] Patent Number: 5,054,695

[45] Date of Patent: Oct. 8, 1991

[54] SHREDDER FOR PAPER AND THE LIKE

[76] Inventor: Pieter G. J. Koornhof, Post Office Box 0776, Orchard Point, Singapore

[21] Appl. No.: 451,965

[22] Filed: Dec. 20, 1989

[30] Foreign Application Priority Data

Dec. 20, 1988 [GB] United Kingdom ..... 8829631

[51] Int. Cl.[5] ..... B02C 19/12; B26D 1/03

[52] U.S. Cl. ..... 241/30; 241/169.1; 241/236; 30/279.2; 30/304

[58] Field of Search ..... 241/236, 169.1, 168, 241/30; 30/304, 279.2

[56] References Cited

U.S. PATENT DOCUMENTS 3,883,953 5/1975 Saullo et al. ..... 30/304
4,798,116 1/1989 Silver et al. ..... 241/168 X
4,821,967 4/1989 Moriyama ..... 241/236 X
4,846,413 7/1989 Inoue ..... 241/236
4,860,963 8/1989 Goldhammer et al. ..... 241/236
4,869,435 9/1989 Pistorius et al. ..... 241/236 X

*Primary Examiner*—Frank T. Yost
*Assistant Examiner*—Frances Chin
*Attorney, Agent, or Firm*—Scrivener and Clarke

[57] ABSTRACT

A shredder for sheets of paper and the like in which a pair of rotatable cutters are used to shred the paper, the cutters being located in a housing which has at least one pair of opposed surfaces, which are remote from the paper entrance to and exit from the shredder, spaced apart by less than 15 cm, whereby the housing can be held between the fingers and thumb of one hand and so can be portable. Preferably the weight of the paper shredder is less than 1.5 kg.

9 Claims, 12 Drawing Sheets

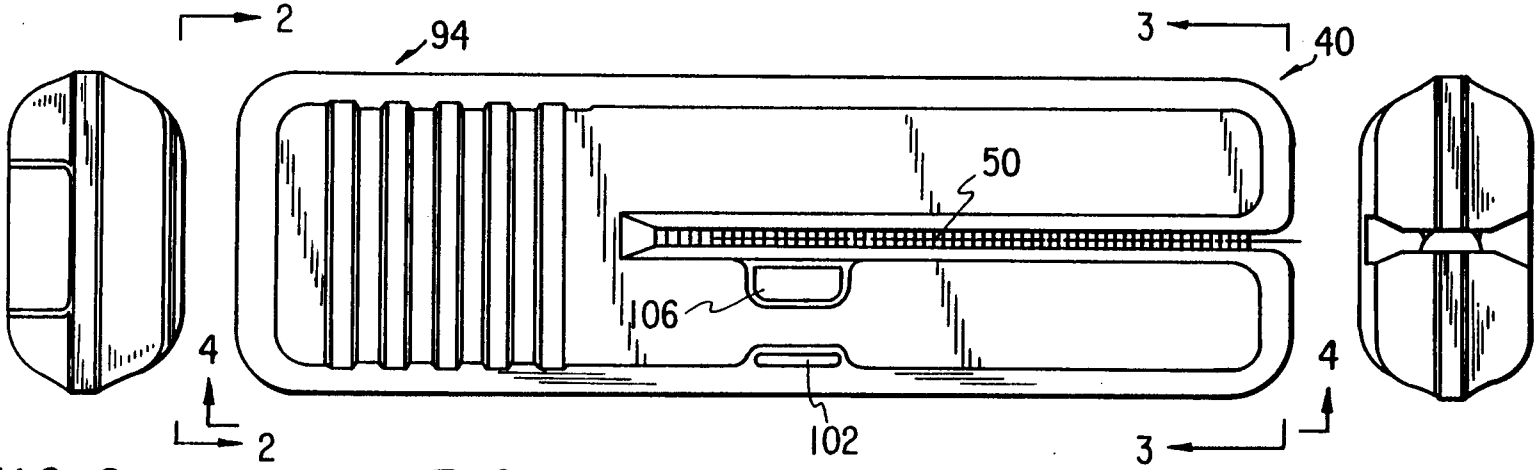
FIG.1
FIG.2
FIG.3
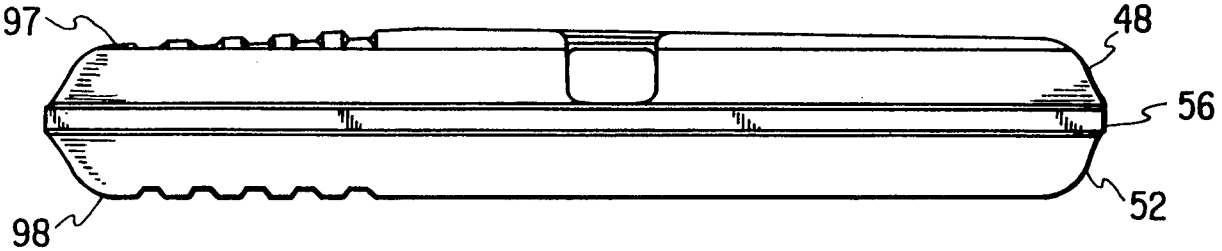
FIG.4

FIG.34
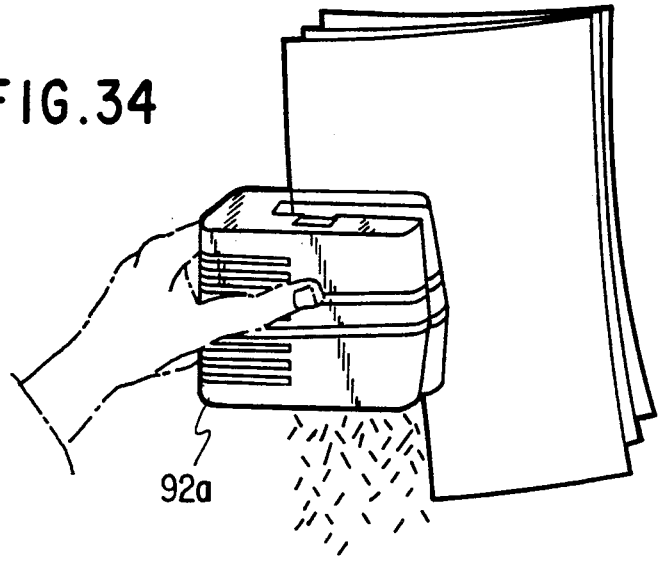
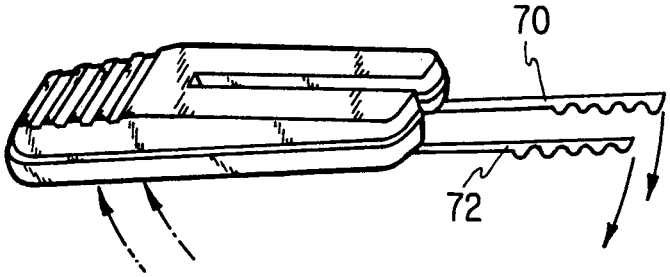
FIG.35
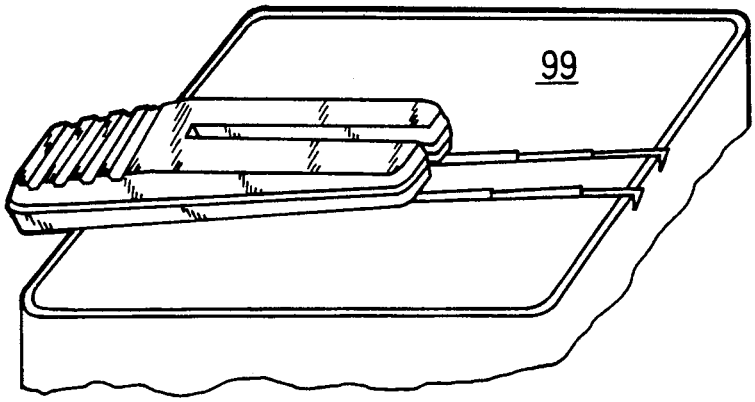
FIG.36

SHREDDER FOR PAPER AND THE LIKE

This invention relates to a shredder for paper and the like.

Two distinct markets for shredders currently exist. The first market is for large industrial shredders, used to shred bulk supplies of paper; typically the paper is brought to the shredder from various sites, tightly compressed in bales, preparatory to shredding for re-use in the manufacture of cardboard. The second market is for smaller office-type shredders, for destroying confidential files or letters under supervision; although primarily designed to shred paper, most office-type shredders are able for example to shred both microfilm and the thin transparent plastic folders in which some confidential papers are stored, as well as being able to cope without jamming with the occasional metal staple.

Office-type shredders are typically free-standing, and powered from the main electricity supply, with an electric motor driving (in the opposite rotational sense) each of a pair of rollers carrying axially-spaced cutter discs; the cutter discs on the respective rollers usually intermesh, and may be formed integrally on the rollers or be of annular construction and located axially along each respective roller. Each office may have its own shredder, but more often a number of offices are required to share a single shredder; since use of a remote shredder may be inconvenient, as can be a requirement for multiple-use, documents which ought immediately to be shredded may in practice be put to one side, and read or copied by unauthorised personnel.

I now propose a portable, hand-held shredder, suitable for destroying confidential papers under supervision. Being portable and hand-held, in an office or group of offices my shredder can be located adjacent any paper needing to be shredded, or it can be carried to the paper i.e. from site to site; fewer free-standing shredders will be required, and those in authority can be more certain that confidential documents to be destroyed will immediately be shredded, perhaps themselves each having one of my shredders. However, I foresee that my portable, hand-held shredder will find its greatest utility away from an office or home site, for instance if it is taken on a business trip, perhaps carried in the user's "brief case".

Preferably my shredder is battery-operated, conveniently with re-chargeable batteries so that it can operate away from an electric power point and without a permanently-fitted electrical lead.

According to one feature of my invention, I provide a shredder for paper and the like comprising a housing, a pair of rotatable cutters between which the paper to be cut can be fed, drive means for the cutters, an entrance for uncut paper, an exit for shredded paper, the entrance and exit defining a paper flow path, the housing locating the drive means and the cutters and providing the entrance and exit, the cutters being between the entrance and exit and in the flow path, the housing having at least one pair of opposed surfaces spaced apart by less than 15 cm to provide a hand-grip.

According to alternative features of my invention, the weight of my paper shredder is less than 1.5 kg; and in part because of its lower weight than office-type shredders, my shredder is adapted to be hand-supported, in cantilever, by way of a hand-grip axially spaced from the entrance and exit for uncut paper and shredded paper respectively. Preferably, the hand-grip will be substantially aligned with the axes of the cutters. Usefully the cutters will have an axial length of less than 21 cm i.e. less than the width of an A4 sheet and will preferably have a length of between 10 cm and 12.5 cm.

In use, preferably the axes of the rollers are substantially horizontal, with the paper being fed downwardly into the shredder, the housing being held in one hand whilst the paper is fed with the other hand.

Thus I also propose a method of shredding paper which includes the steps of holding a paper shredder with one hand by way of a hand-grip spaced from a pair of rotatable cutters located within the paper shredder, causing the cutters to rotate, and feeding paper or the like between the cutters with the other hand. The hand-grip will preferably be axially spaced from but substantially aligned with the axes of the rotatable cutters. Conveniently one end of the paper entrance and paper exit will be open to permit paper of greater width than the length of the cutters to be fed unfolded between the cutters, with the paper which on the first pass is outside the cutters thereafter being fed between the rollers in one or more subsequent passes i.e. with a multi-pass shredding method; however in embodiments wherein both ends of the entrance and exit are closed, paper of width greater than the length of the cutters, or of the length of the entrance and/or exit slots, will first need to be folded. In both types of embodiment the entrance slot will conveniently be of a restricted width, to help prevent jamming of the cutters by limiting the number of sheets which can simultaneously be fed to the cutters.

The hand-grip will in part be defined by at least one external surface of the housing. Conveniently this surface also helps define internally of the housing a housing portion including a motor chamber, locating an electrically-driven motor which when energised will cause the cutters to rotate. In one embodiment, this housing portion also internally locates one or more batteries used to power the motor, so that a cordless "vertical-embodiment" paper shredder with reduced cantilever loading and offset dimensions can be assembled. However, in one alternative cordless "horizontal-embodiment" a plurality of electric storage "dry" batteries are located parallel to and to each side of the cutters; whilst in another alternative "horizontal-embodiment" the batteries are located parallel to but to one side only of the cutters, the intermeshing cutting edges of which are thus spaced from the central axis of the housing, as is the flow path of the paper between the entrance and exit.

If desired, the motor can be arranged to drive the cutters in reverse, so that paper trapped between the cutters can be released, the reverse drive perhaps being at a slower speed but with greater torque. Although my shredder entrance is preferably designed so that only a few sheets of paper can be fed into the entrance at any one time, to further help prevent paper jamming within the shredder I can provide cutters comprising a plurality of intermeshing discs each with an inclined sawtooth profile, with adjacent discs having their teeth relatively advanced, whereby the sheets of paper are drawn between the cutters one at a time; conveniently when a sheet is so drawn between the cutters there is a transverse cutting or tearing process in advance of the longitudinal or strip cutting process.

The invention will be described by way of example with reference to the accompanying drawings, in which:

FIG. 1 is a plan view from above of a shredder according to the invention, illustrating a paper entrance;

FIG. 2 is an end elevation on the line 2—2 of FIG. 1;

FIG. 3 is an end elevation on the line 3—3 of FIG. 1;

FIG. 4 is a side elevation on the line 4—4 of FIG. 1;

Figure 9:
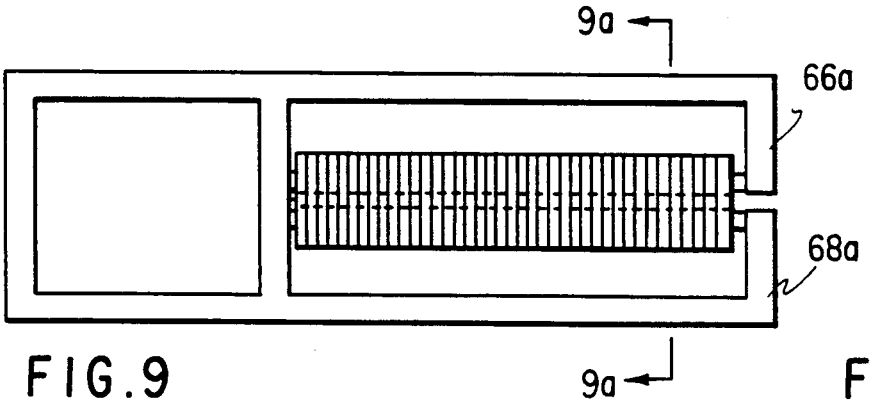
FIGS. 9-15 are of alternative frames or lower housing parts.
Figure 9A:
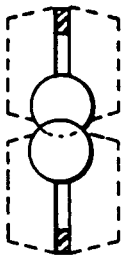
Figure 13:
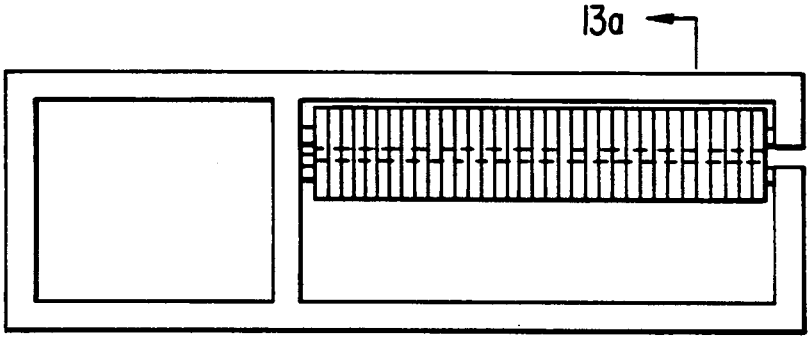
Figure 13A:
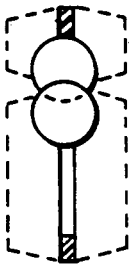
Figure 14:
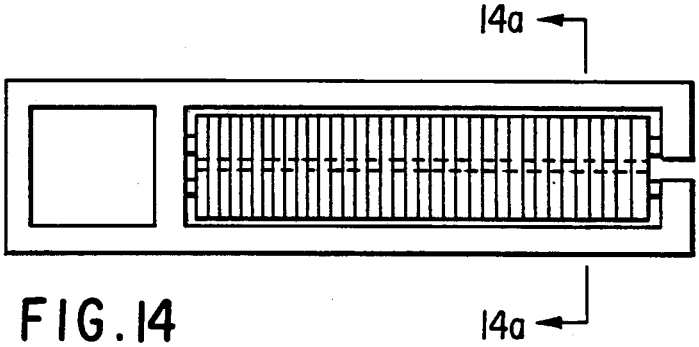
Figure 14A:
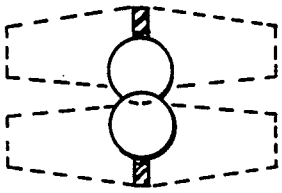
Figure 17:
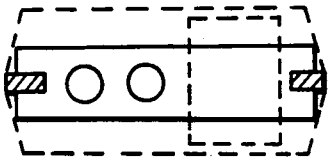
Figure 19:
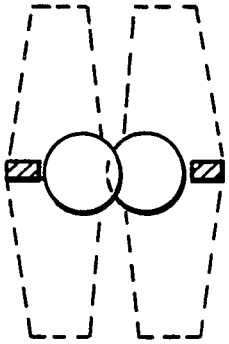
Figure 20:
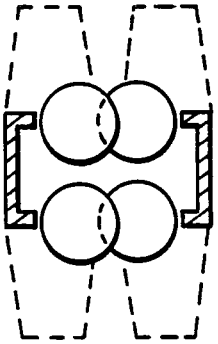
Figure 16:
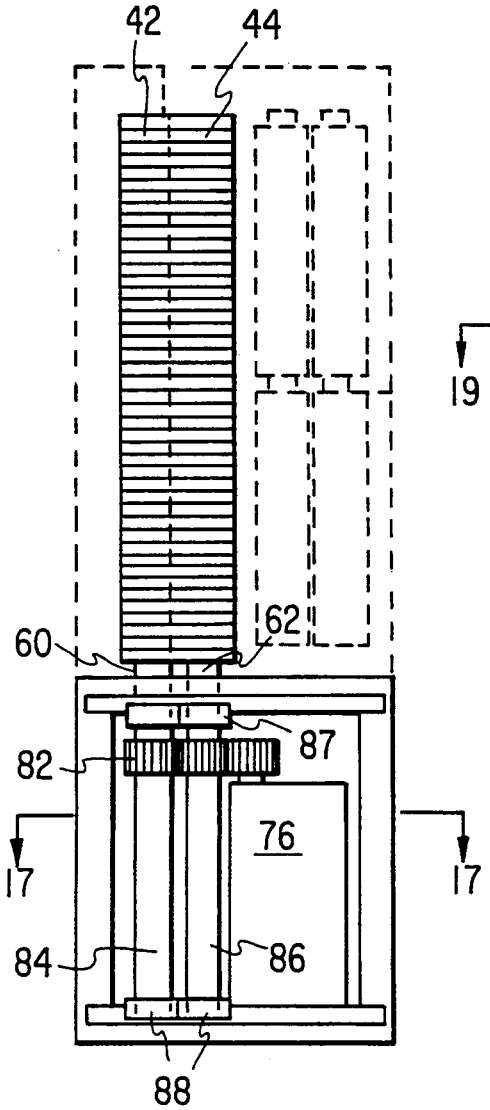
Figure 18:
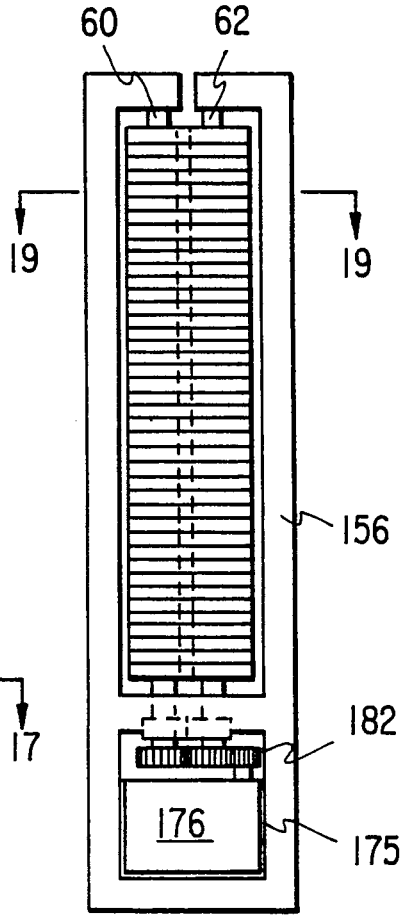
Figure 22:
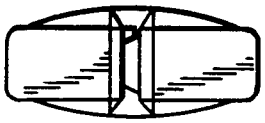
Figure 21:
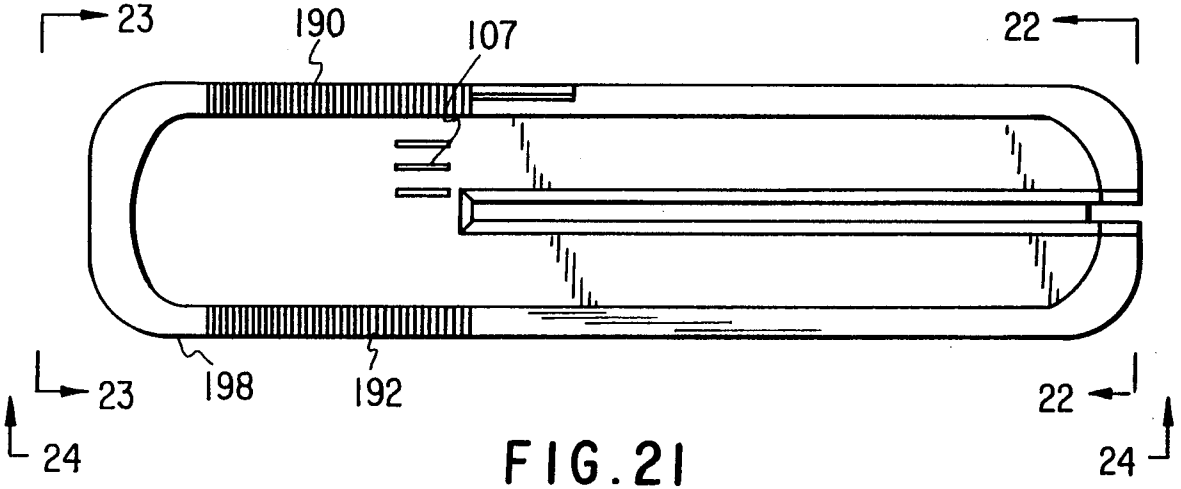
Figure 24:
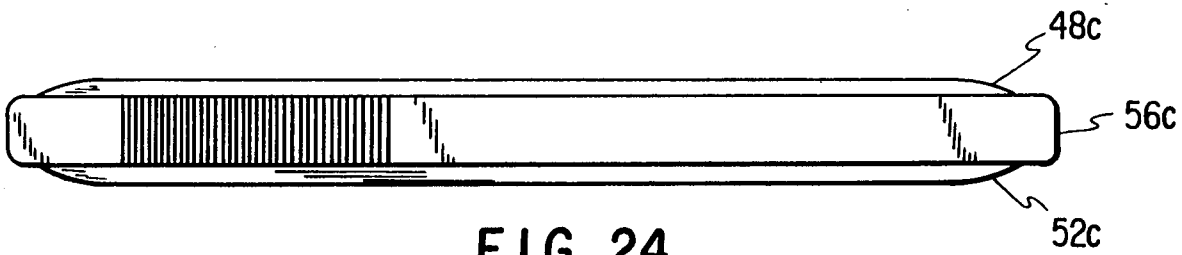
Figure 23:
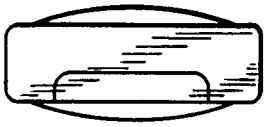

FIG. 9*a* is a view on the arrowed line on FIG. 9;

FIGS. 11*a*-15*a* are views on the arrowed lines respectively of FIGS. 11-15;

FIG. 16 is a view corresponding to FIG. 13, in more detail;

FIG. 17 is a view on the line 17—17 of FIG. 16;

FIG. 18 is a view corresponding to FIG. 14, in more detail;

FIG. 19 is a view on the line 19—19 of FIG. 18;

FIG. 20 is of an alternative embodiment to that of FIG. 19, along a line corresponding to line 19—19 of FIG. 18; but of an embodiment with a double pair of cutters;

FIG. 21 is a plan view from above of another embodiment of shredder, with a channel frame;

FIG. 22 is a view on the line 22—22 of FIG. 21;

FIG. 23 is a view on the line 23—23 of FIG. 21;

FIG. 24 is a view on the line 24—24 of FIG. 21

Figure 10:
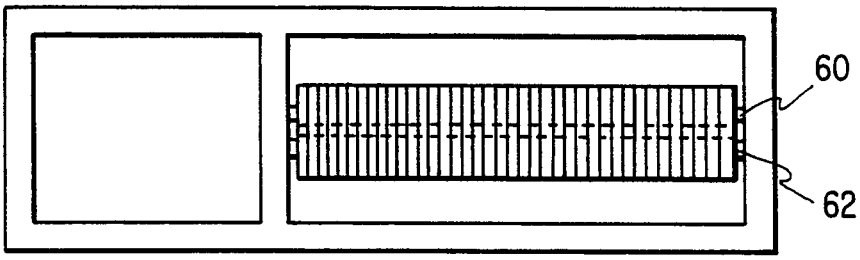
Figure 25:
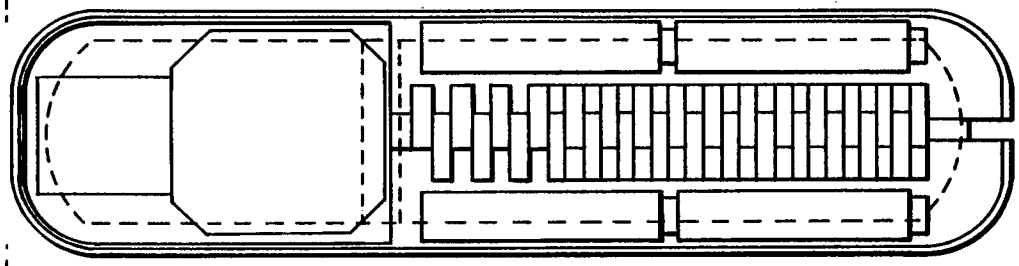
Figure 26:
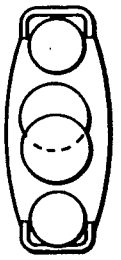
Figure 27:
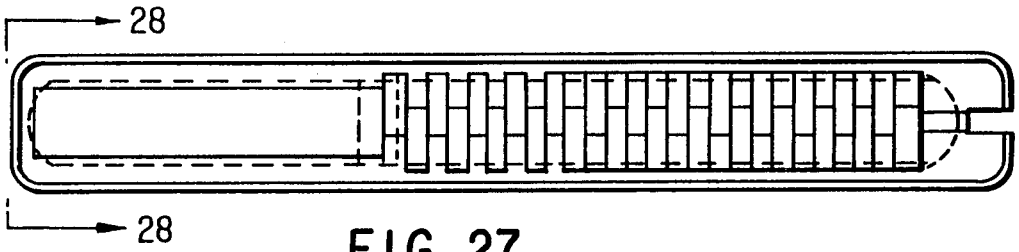
Figure 28:
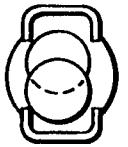
Figure 29:
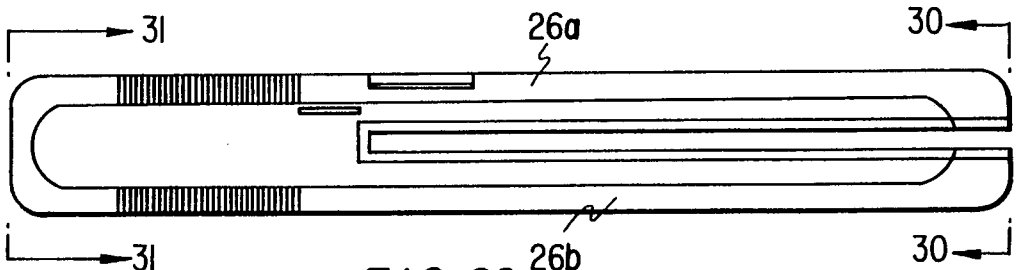
Figure 30:
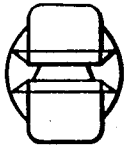
Figure 31:
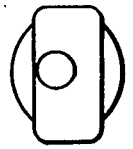
Figure 32:
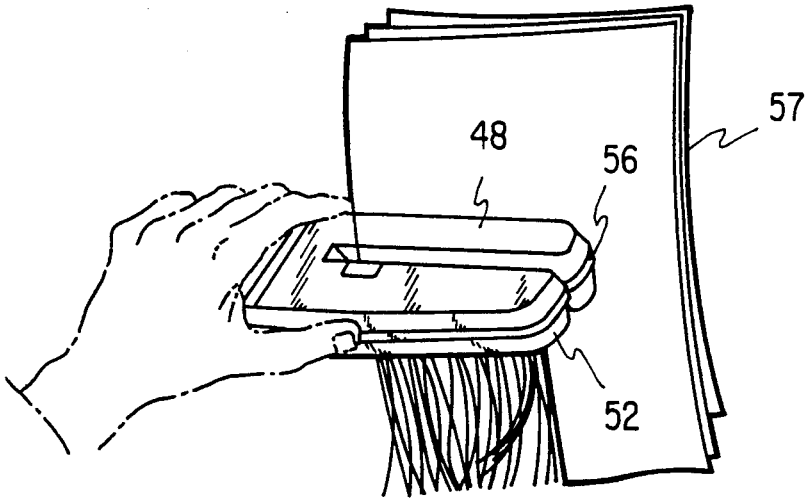
Figure 33:
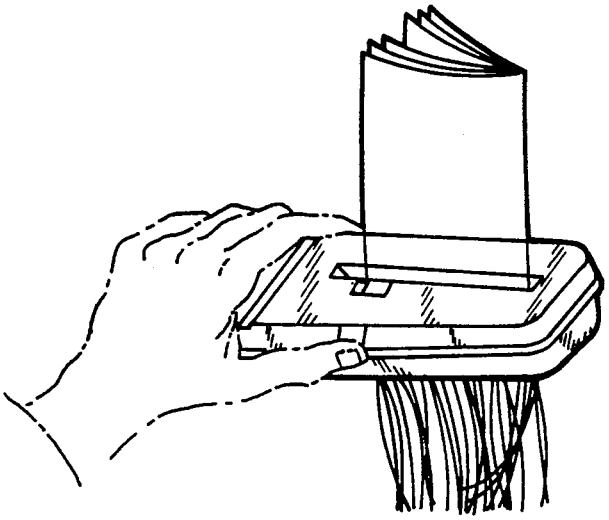
Figure 37:
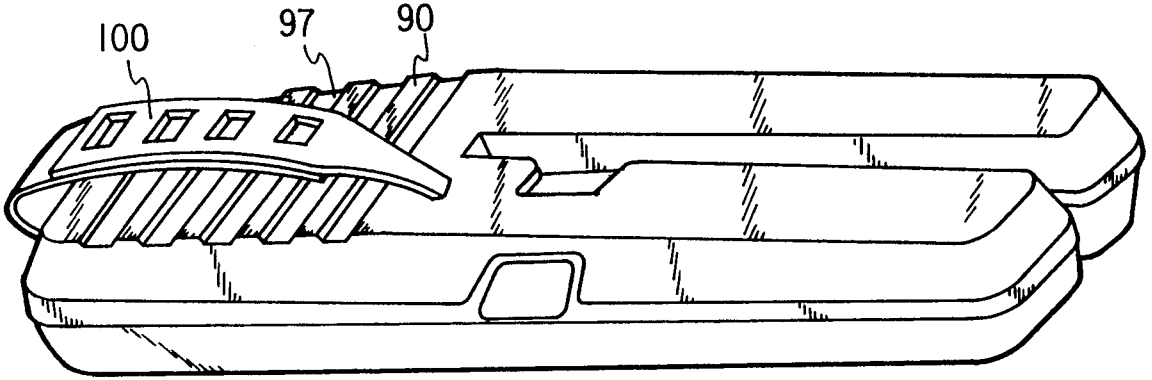
Figure 38:
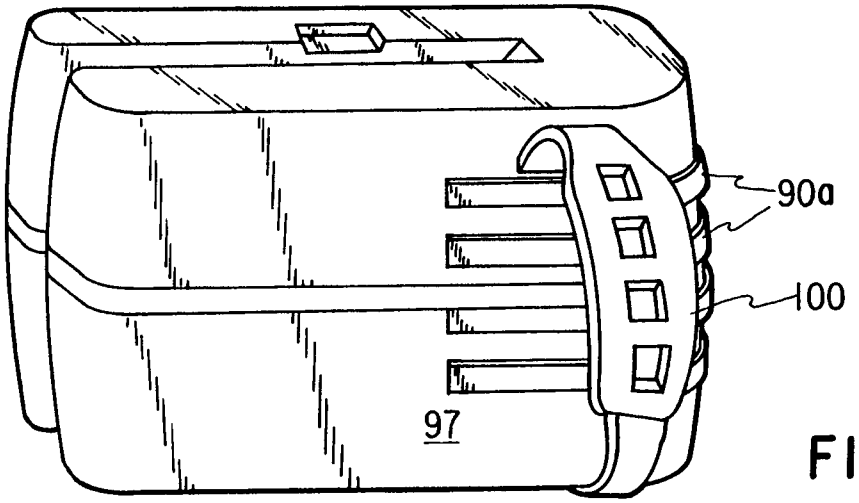

FIG. 25 is a view on the line 25—25 of FIG. 21;

FIG. 26 is a view on the line 26—26 of FIG. 21;

FIG. 27 is of yet a further embodiment of shredder, without battery operation, with the upper housing part (or top cover) removed;

FIG. 28 is a view on the line 28—28 of FIG. 27;

FIG. 29 is a plan view, corresponding to that of FIG. 27, but with the upper housing part in position;

FIG. 30 is a view on the line 30—30 of FIG. 29;

FIG. 31 is a view on the line 31—31 of FIG. 29;

FIG. 32 is a perspective view of the embodiment of FIG. 1, in use;

FIG. 33 is a perspective view of a closed-slot embodiment similar to that of FIG. 10, but with rounded corners, in use;

FIG. 34 is a perspective view of an embodiment similar to that of FIG. 14, but with rounded corners, in use;

FIG. 35 is of a modification of the embodiment of FIG. 1;

FIG. 36 is of another modification of FIG. 1; FIG. 37 is a view corresponding to FIG. 1 but with a hand-support strap; and FIG. 38 is a view of the embodiment of FIG. 23, from the opposite side, but including a hand-support strap.

In the various embodiments, similar parts are similarly numbered.

In the embodiment of FIGS. 1-7, the shredder 40 includes a pair of oppositely-rotatable cutters 42,44 mounted in a housing 46. The housing is fabricated from three parts, namely an upper (as seen in FIG. 4) part 48 which provides a paper entrance slot 50; a lower part 52 which provides a (shredded) paper exit slot 54; and a cutter support part or frame 56, which is sandwiched between upper part 48 and lower part 52. Upper part 48 is securely fixed to frame 56; whilst lower part 52 is releasably fixed to frame 56 by screw 53 so that the batteries 178 (and the cutters 42,44) can be inspected and replaced as required.

Figure 5:
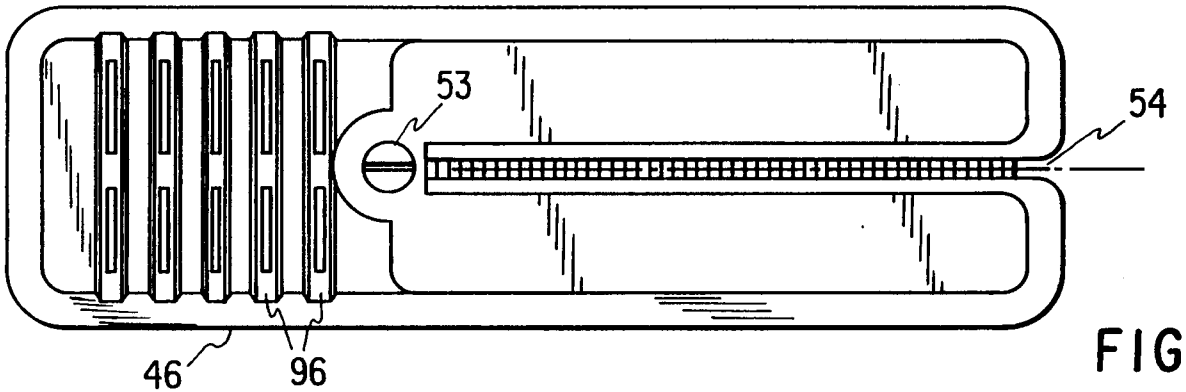
FIG. 5 is a plan view, from below, illustrating a shredded paper exit, and motor ventilation slots.
Figure 6:
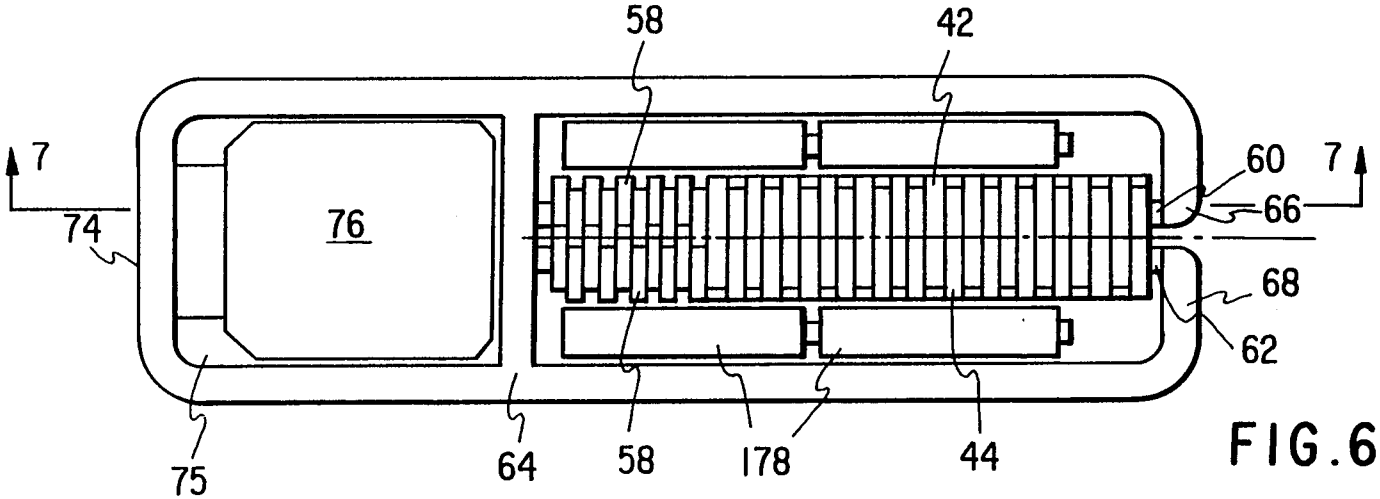
FIG. 6 is a plan view, partly schematic, of the shredder of FIGS. 1-5, with the top cover removed.
Figure 7:
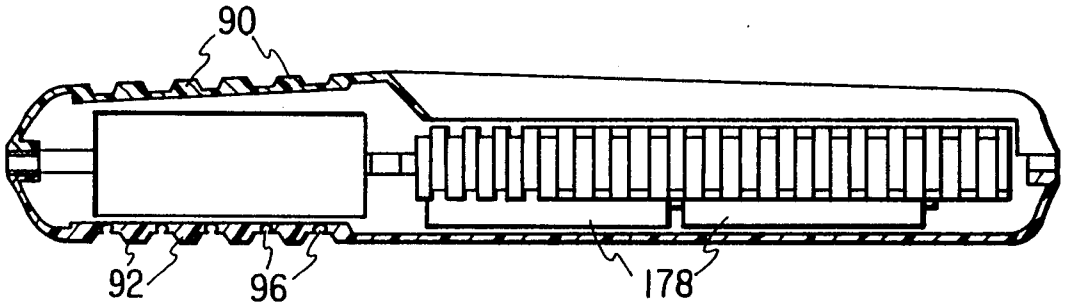
FIG. 7 is a schematic view on the line 7—7 of FIG. 6.

As indicated schematically in FIG. 6 the cutters comprise individual cutter discs 58 axially spaced apart along the respective spindles 60,62. The spindles 60,62 are rotatably mounted in trunnions (not shown), at one end in a cross-member 64 and at the other end one in each of a pair of spaced-apart end members 66,68. The cutter discs 58 on one spindle 60 intermesh with the cutter discs 58 on the other spindle 62, the intermeshing position being in the paper flow path between entrance slot 50 and exit slot 54. Cross-member 64 gives added rigidity to the cutter support part 56.

Figure 8A:
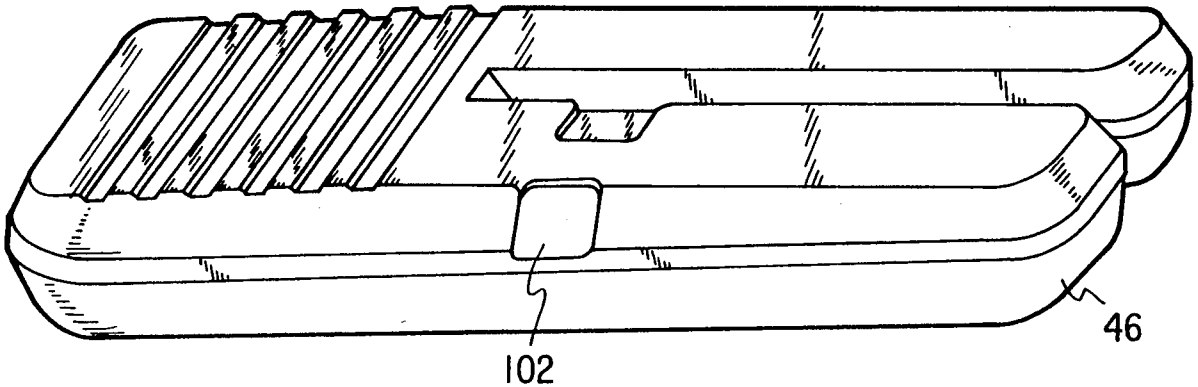
FIG. 8 is an exploded view, in perspective, of a shredder similar to that of FIGS. 1-7, partly schematic.
Figure 8B:
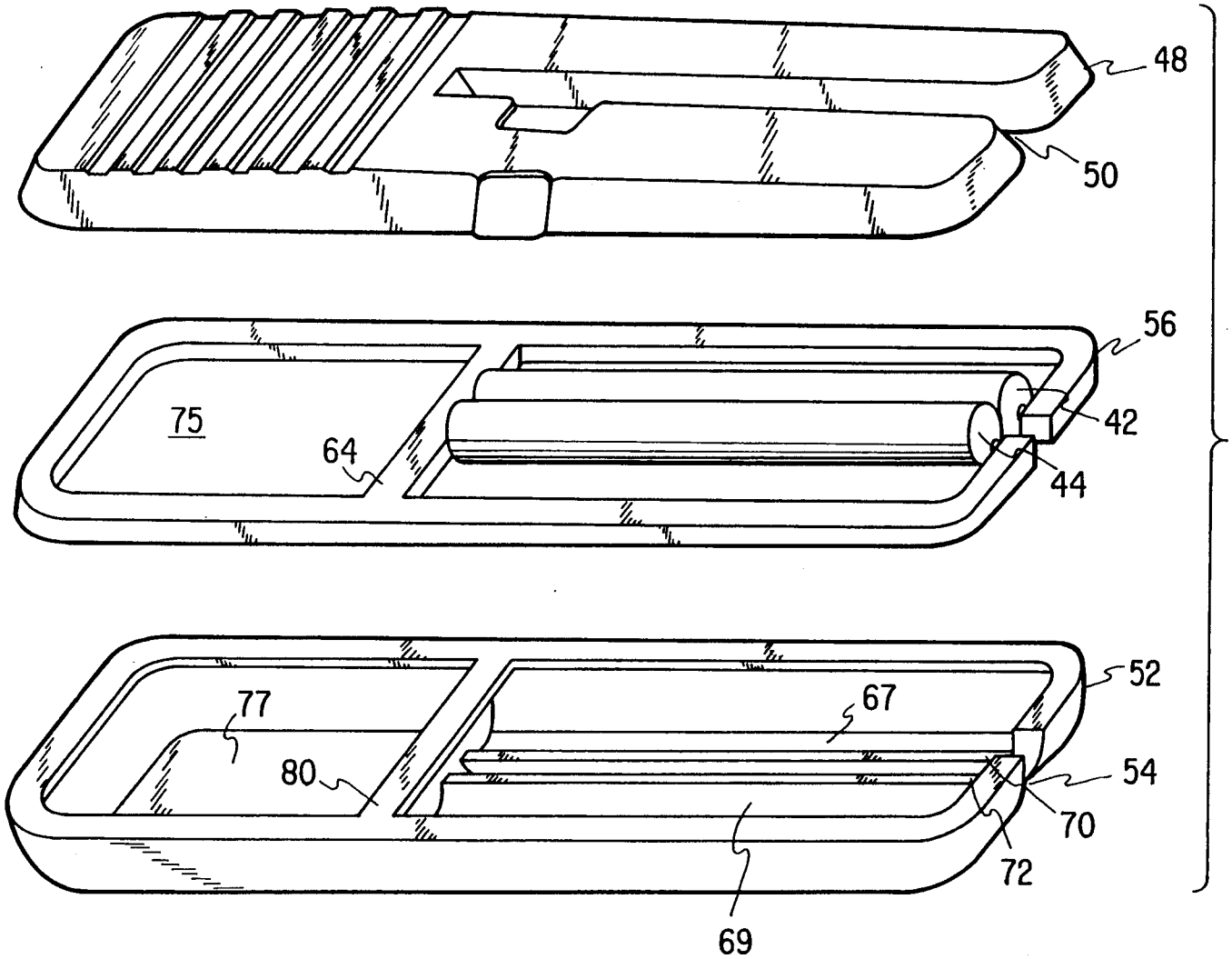

As best seen in the exploded view of FIG. 8, lower housing part 52 is shaped to provide a pair of battery compartments 67,69, these compartments having facing edges 70, 72 which define the exit slot 54. Cutter support part 56 provides a motor chamber 75 in which is located a motor 76 (FIGS. 1-7) and which in this embodiment can alternatively be battery or mains operated, and mains electricity connector plug 74. Lower part motor chamber 77 is separated from the battery compartments 67,69 by partition 80 (aligned with partition 64 of the frame 56); when assembled, batteries 178 are electrically connected to the terminals of motor 76 through the partition 80.

The embodiment of FIG. 8 is generally similar to that of FIGS. 1-7, except that the hand-grip surfaces (surfaces 97,98 of FIGS. 1-7) are parallel. In particular, FIGS. 1-7, and FIG. 8 are each of a "horizontal-embodiment" wherein the battery compartments are spaced from the motor in a direction generally perpendicular to the direction of paper flow in the shredder. In alternative embodiments motor 75 is mounted in the lower housing chamber 77; screw 53 retains only a cover for the batteries.

As best seen in the "horizontal-embodiment" of FIG. 16, motor 76 is connected by gearing to cutter spindles 60,62 so that these are each driven in an opposed rotational sense; and in this embodiment at a different angular velocity to that of the motor drive output. However, in the embodiment of FIG. 16, the cutter spindles have extensions 84,86 which are mounted in trunnions 87,88 so that the cutters 42,44 are suspended in cantilever; the motor 76 is drivingly connected by the gearing 82 to these extensions 84,86.

Figure 15:
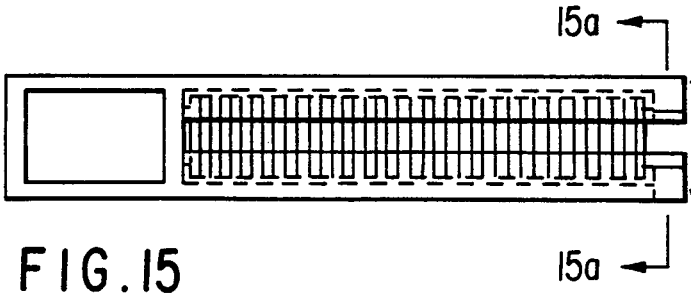

FIGS. 14,15 and 18 are of "vertical-embodiments" in which the battery compartment is positioned in the paper flow direction relative to the motor, in these embodiments below the motor in the lower housing part. In the embodiment of FIG. 18, cutter support part 156 includes a motor chamber 175 which receives the motor 176, and the gearing 182; the batteries are not seen, and would be below (in the direction as viewed in FIG. 18) the motor 176, in the lower housing part. As can be seen in FIG. 34 and FIG. 38, this embodiment is therefore of shorter length in the axial i.e. cutter spindle direction, with less (axial) cantilever but greater transverse (vertical) depth.

As seen in FIGS. 1,4,5, and 7 the housing upper part 48 has external ridges 90, and the housing lower part 52 has external ridges 92. In this embodiment the ridges 90,92 are formed on opposed, inwardly tapering (axially away from the cutters) external surfaces 97,98 of the housing 46; one or both sets of ridges in part define a hand-grip 94. The length of the individual ridges in this embodiment is 12 cm, but in alternative embodiments is less, so that as seen in FIGS. 32,33 the housing 46 can be comfortably hand-held; though it can be up to 15 cm. In an alternative embodiment where the housing is intended to be gripped between (rather than by) the fingers and thumb, the spacing between the sets of ridges 90,92 is 12 cm. Surfaces 97,98 partly enclose and define motor chamber 75. The lower housing part 52, which will not normally be covered by the hand in use, includes ventilation slots 96 between the ridges 92 to permit the escape of air heated by the motor 76.

As seen in FIG. 34, and in FIG. 38, which are each of a "vertical-embodiment" the respective ridges 92*a*, 90*a* can be axially disposed i.e. generally parallel to the cutter spindle axes; with ventilation slots between ridges 92*a*.

The "square-corner" frame embodiment of FIG. 9 is similar to that of FIG. 1 and FIG. 8 in providing entrance and exit slots each having one open-end remote from the drive motor 76, and defined by end members 66*a*,68*a*. Thus as seen generally in FIG. 32, one or more sheets of paper 57 e.g. of A4 size, can be shredded by multi-passage through the shredder.

The frame embodiment of FIG. 10 has closed-end entrance and exit slots, i.e. the end members are connected, so that as seen in FIG. 33 A4 sized paper 57 will need to be folded before being fed into the entrance slot 50.

Figure 11:
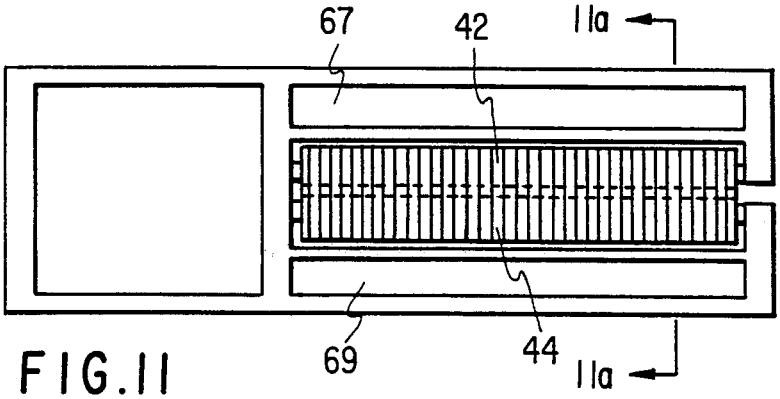
Figure 11A:
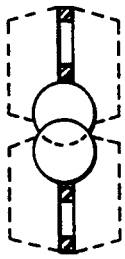

FIG. 11 is of a square-cornered cutter support part or frame, but which is otherwise generally similar to the frame embodiment of FIG. 6 and FIG. 8 in having battery compartments 67,69 to either side of the intermeshing cutters 42,44.

Figure 12:
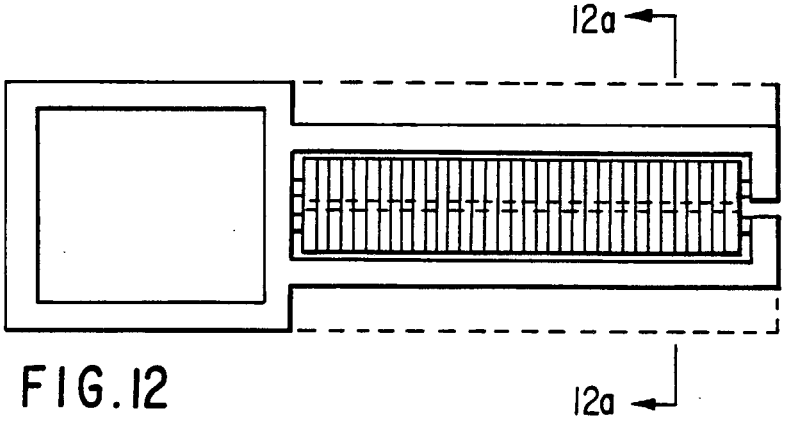
Figure 12A:
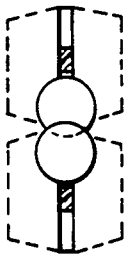

FIG. 12 is of a modified frame design, in which the battery compartments are in part positioned below (when viewed in plan) the respective cutters, the facing edges of the battery compartments however still defining the shredded paper exit.

FIG. 13 is a further frame embodiment in which the cutters are offset from the mid-axis of the frame, with the or each battery compartment being located to one side of the cutters when viewed from above.

FIG. 14 is of a "vertical-embodiment" frame, generally similar to that used in FIG. 34, with the cutters intermeshing on the central axis of the frame, and the paper flow path in the central plane of the shredder.

Figure 15A:
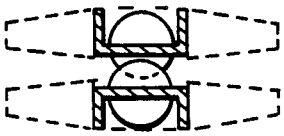

FIG. 15 is of yet a further "vertical-embodiment" frame, of slimline construction, the end members 66*b*,68*b* being of channel-section, as seen in FIG. 15*a*.

FIG. 16 is of a frame generally similar to that of FIG. 13 with the cutters (and thus the entrance and exit slots) offset from the central axis of the frame.

The embodiment of FIGS. 21–26 has an enlarged cutter support part or frame 56*c*, with upper part 48*c* and lower part 52*c* both of reduced size and merely acting as protective covers. Upper housing part 48*c* includes slits 107 through which can be seen the light from a lamp (not shown) which illuminates when the motor is energised. Small-height ridges 190, 192 are formed on parallel surfaces 197, 198. As compared to the previously-described embodiments, frame 56*c* is widened, being not only a hollow frame part but also a partly-open channel, thus becoming the principal housing part; in addition to the motor, gearing and cutters, frame 56*c* may also house the batteries.

For the ultra-slimline embodiment of FIGS. 27–31, in which the motor is powered only by a mains electricity connection, the side walls 256*a*, 256*b* of the frame can respectively partly embrace the cutters 42, 44. In an alternative embodiment, these side walls can extend yet further to define the entrance slot 50 and the exit slot 54, these walls perhaps being interconnected to form a two-part housing i.e. so that the separate upper, lower and cutter support, parts of the above-described three-part housings are not used.

In the modified embodiment of FIG. 35, there are pivotally mounted extensions 70, 72, which when not in use can be swung in the direction of the arrows, to locate against the lower part of the housing. In the position shown in FIG. 35 the extensions can be used (as seen in FIG. 36) to mount the shredder on a waste bin 99, so that the shredded paper can immediately be disposed of, cleanly and neatly. This embodiment has only one of surfaces 97, 98 inwardly tapered i.e. surface 97.

In an alternative embodiment, the extensions can be telescopic, and so can be slid axially back below the housing.

In the embodiments of FIG. 37 and FIG. 38, a separate hand strap 100 is fitted, permitting the shredder to be held more securely; and also so that e.g. both surfaces 97, 98 do not have to be gripped (between fingers and thumb). This embodiment is thus likely to be of value to those users with small hands or with a disability. The strap can be made removable, from adjacent respective ridges 90, 90*a*; and is adjustable in length.

The housing is of strong light-weight metal; though in alternative embodiments it can be of metal alloy, graphite composite or tough plastic such as that known as ABS. Part of the exterior of the housing may be laminated with a proprietary material to give a smooth touch and leather-like feel.

In use, for battery operation the motor is started by pressing (or sliding) switch 102. In an embodiment using a re-chargable battery, the battery can be arranged to be recharged through plug 74; though in an alternative embodiment, plug 74 is used for a cord connection for direct (mains) energisation of the motor under the control of switch 102. Light emitting diodes 106 (FIGS. 1–7) can be used to indicate when the motor is energised. Switch 102 may additionally be of the type to provide reverse rotation of the motor, if the cutters need to be freed of jammed paper; though alternatively the gearing between the motor and cutter spindles could either be disengaged or caused to reverse.

Although intended to be electrically powered, preferably as a cordless shredder, I do not exclude the cutters being manually rotated, either in the normal rotation mode for shredding or in the reverse rotation mode (to free jammed paper etc from between the cutters). The slimline embodiments such as that of FIGS. 27–31 (and in general the lighter weight embodiments for which the cantilever-type loading can be accepted by the user with the disclosed hand-grip arrangements) can be made of a length to include cutters able to accomodate A3 paper presented lengthwise or A4 paper without folding, whether presented "sideways-on" or "lengthways-on" (FIGS. 32, 34) e.g. of a length of 30 cm or perhaps even 35 cm. Particular embodiments may be made of a length to fit into a standard briefcase i.e. up to 45 cm. In one alternative embodiment the frame 56 (FIG. 1) can be omitted, and the shredder components mounted on one or both of upper part 48 and lower part 52. For those embodiments in which the pair of cutters are supported at one end by a split housing part, that end can be strengthened by a tension bar or wire, which acts to bridge the two legs of the housing to help prevent the legs from opening when paper etc. is feeding between the cutters. If required, a small gearbox can be fitted between the motor and the cutters in order to increase the torque and lower the rotational speed of the cutter, as shown generally in FIG. 16 and FIG. 18. Two small slotted screens can be fitted between the cutters to help guide the paper which is about to be cut along the flow path between the slots, and to help prevent curling and wrapping around the cutters of the cut strips of paper.

With the cutter shaped as in FIG. 34 the surfaces for the hand grip are provided on faces 10, 12, which in use are substantially vertical faces, so that the palm of the hand is "intersected" by the axes of the cutters; whereas for the embodiment of FIG. 32, although the surfaces 10, 12 are still substantially vertical in use, the palm of the hand is offset from the axes of the cutters.

I claim:

1. A method of shredding a cuttable sheet by a portable shredder having an entrance for a sheet and an exit for a shredded sheet, said entrance and exit having one side which is at all times open, comprising holding the shredder with one hand by way of a hand grip with said shredder and said open sides extending away from said hand grip in cantilever fashion, said hand grip being spaced to one side of a pair of rotatable rollers located within said shredder, causing the rollers to rotate, feeding a first part of said cuttable sheet to the rollers with the other hand and with the remaining part of said sheet projecting through and beyond said open sides of said entrance and exit, continuing to feed said sheet until said first part is shredded and discharged through said exit, and then feeding said remaining part of said sheet continuously through said entrance until it also is shredded and discharged through said exit.

2. A shredder for paper comprising a housing, an entrance in the housing for uncut paper, an exit in the housing for shredded paper, roller means in said housing for conveying paper between said entrance and exit, cutter means in said housing cooperating with said roller means for shredding paper as it is conveyed between said entrance and exit by said roller means, and power means in said housing for driving said roller means, said entrance and exits each having one and the same side which is at all times open to accept a paper sheet which is wider than said entrance.

3. A portable shredder for paper comprising a housing of a size to be held in the hand during shredding, a pair of dual purpose rollers located in the housing, each roller being a conveyor roller and a cutter roller and being rotatable about an axis, drive means in said housing to rotate the rollers, an entrance in the housing for uncut paper, an exit in the housing for shredded paper, said rollers being between said entrance and exit to define a paper flow path which extends between said rollers, said housing having at least one pair of opposed external surfaces spaced apart by less than 15 cm to define a hand grip located to one side of said flow path, said drive means including a motor, a chamber for said motor located in said housing between said at least one pair of external surfaces defining said hand grip, each roller having cutting edges parallel to the paper flow path, the cutting edges being spaced apart perpendicular to the paper flow path, said entrance and exit each having one and the same side which is at all time open to accept a sheet wider than the entrance.

4. A shredder according to claim 3 wherein the opposed surfaces are parallel to a roller axis, but offset therefrom, and wherein a handstrap partly covers one of the opposed surfaces.

5. A shredder according to claim 3 wherein an electrically driven motor connected to the cutters, one of said opposed surfaces include ventilation apertures.

6. A shredder according to claim 3 wherein the motor is powered by storage batteries located alongside the rollers, the batteries each having a longitudinal axis which intersects the motor.

7. A shredder according to claim 3 wherein the housing has a central axis and wherein the rollers are offset from that central axis of the housing, and wherein the flow path of the paper between the entrance and exit is also offset from that central axis.

8. A shredder according to claim 3 including means to drive the rollers in reverse to effect release of paper trapped between the rollers.

9. A shredder according to claim 3 wherein the rollers comprise identical discs, the discs of one roller of a pair of rollers being mounted to intermesh with a pair of discs of the other roller of the pair of rollers, each disc having an inclined saw tooth periphery, with the respective discs having their saw teeth non-aligned.

* * * * *